US005386772A

United States Patent [19]

Tolle et al.

[11] Patent Number: 5,386,772

[45] Date of Patent: Feb. 7, 1995

[54] HIGH SPEED MEDIA MANAGEMENT DEVICE

[75] Inventors: Charles V. Tolle, Encino; Mark A. Hitz, Granada Hills; Robert P. Johnson, St. Clarita; Steven C. Szabo, La Canada-Flintridge, all of Calif.

[73] Assignee: Datametrics Corporation, Woodland Hills, Calif.

[21] Appl. No.: 77,289

[22] Filed: Jun. 15, 1993

[51] Int. Cl.[6] ..... B41F 13/24

[52] U.S. Cl. ..... 101/248; 101/228; 101/181; 400/708; 400/618; 226/45; 226/38

[58] Field of Search ..... 400/120, 228, 611, 617, 400/578, 223, 708, 629; 226/2, 24, 26, 27, 28, 29, 30, 34, 38, 39, 36, 42, 45, 188; 242/183, 184, 186, 188, 189, 190, 57, 57.1; 101/248, 181, 219, 225; 377/3

[56] References Cited

U.S. PATENT DOCUMENTS

| | | | |
|---|---|---|---|
| 3,081,700 | 3/1963 | Kieckhefer, Jr. | 101/248 |
| 3,734,011 | 5/1973 | Williams | 101/91 |
| 4,147,104 | 4/1979 | Zernov et al. | 101/181 |
| 4,205,769 | 6/1980 | Blitchington | 228/45 |
| 4,243,925 | 1/1981 | Gnuechtel | 101/181 |
| 4,264,957 | 4/1981 | Pautzke | 101/248 |
| 4,366,372 | 12/1982 | Sargent | 377/3 |
| 4,370,665 | 1/1983 | Scranton et al. | 400/704 |
| 4,485,982 | 12/1984 | St. John et al. | 242/57.1 |
| 4,722,275 | 2/1988 | Taguchi et al. | 101/228 |
| 4,757,930 | 7/1988 | Ditto | 226/27 |
| 4,892,426 | 1/1990 | Steele | 400/708 |
| 5,016,182 | 5/1991 | Bergland et al. | 226/28 |
| 5,018,443 | 5/1991 | Bolger | 101/228 |
| 5,159,350 | 10/1992 | Minaminaka | 400/621 |
| 5,218,380 | 6/1993 | Fiscella | 400/120 |
| 5,228,792 | 7/1993 | Crevecoeur et al. | 400/708 |
| 5,247,314 | 9/1993 | Stephenson | 400/120 |

FOREIGN PATENT DOCUMENTS

| | | | |
|---|---|---|---|
| 148890 | 7/1949 | Australia | 226/45 |
| 3729911 | 3/1989 | Germany | 101/228 |
| 0115279 | 9/1981 | Japan | 400/120 MC |
| 0097953 | 6/1984 | Japan | 226/38 |
| 0018364 | 1/1985 | Japan | 400/120 MC |
| 8400059 | 8/1985 | Netherlands | 226/45 |

OTHER PUBLICATIONS

"Document Tracking System" IBM Technical Disclosure Bulletin, vol. 25, No. 12, May 1983, p. 6564.

*Primary Examiner*—Eugene H. Eickholt
*Attorney, Agent, or Firm*—Marvin H. Kleinberg

[57] ABSTRACT

A high speed media management device has tractor means for moving a web through the device past a plurality of work stations at each of which the web may be treated. Relatively high web tension is maintained throughout its travel path. Counting means near the beginning of the web path generate a count signal with the passage of each increment of web. The accumulated count signals are compared to numbers stored in a plurality of registers, each register associated with a work station and each containing a count representative of web travel distance relative to the work station. The first register count corresponds to the distance required to accelerate the web from a stop. The remaining registers store that count and a separate count representing the distance between the first station and the corresponding station. When the counter contents equals the count in a register, an actuating signal initiates a treatment activity at the associated work station. At predetermined intervals thereafter, additional actuating signals generated and applied.

16 Claims, 3 Drawing Sheets

HIGH SPEED MEDIA MANAGEMENT DEVICE

The present invention relates to media management devices and, more particularly, a web transport system for a high speed thermal color printer which combines sequentially applied monochrome images into a full color image in the course of a single pass of the medium.

One available printing process (dye diffusion thermal transfer or "D2T2") uses a ribbon which is impregnated with a dye that can be made to diffuse into the surface of a medium. Because this method depends upon the diffusion of a dye into a medium, it is a relatively slow process and high speed media movement is not a requirement, given the limitations of presently available dyes.

A second process, approximately ten times faster, uses colored wax "ribbons" (thermal wax transfer process or "TWT"). At the present time, full color printers are available that work in the thermal wax transfer ("TWT") process in which a print head, having a plurality of individually addressable electrodes that can be selectively heated, transfers dots of wax from a ribbon to a medium, usually paper. Such printers are generally designed to work at a print density of up to 400 dots per inch.

Complete images in full color are created by sequentially depositing colored wax dots in complete or partial superposition such that several colors can be created, much in the fashion of multicolor impression printing in which several engraved image plates are inked, each in a single color and each ink image is separately transferred to the medium. In most color print systems, images in each of three primary colors together with black, are printed in registration so that the finished picture is a composite image. The color in any incremental area of the finished print is determined by the relative amounts of each primary color present in that incremental area.

In the prior art, it has been taught that a single ribbon can contain each of the desired colors in adjacent color bands. If a single print head for impact printing included five to seven lines of styli which were selectively energized to produce a multi dot row at each printing pass, then a ribbon could be designed that contained stripes of color, each the width of a multi-row line. The ribbon would then be advanced through four print cycles, one for a line of each color, before the medium was advanced. If each color band was, in the direction of travel, as large as one "page" or document, the paper would have to be repositioned with respect to the print head after each color has been printed, prior to printing the next color. The process is repeated until all of the colors have been printed.

Both of these approaches were limited by the need to provide a plurality of colors in a single ribbon, and the length of the document was usually limited to the length of the area allotted to each color.

To print in the thermal wax transfer process, an individual printing electrode is heated by passing an electrical current through the electrode. A film carrying wax of a single color is placed in intimate contact with a web, conventionally paper, but which could be fabric, plastic film or metallic foil, upon whose surface a wax dot is to be deposited.

The "sandwich" thus formed is held against the electrode by a roller which acts as both a platen and a heat sink. Where the temperature of the film exceeds the melting temperature of the wax, a small area of wax melts. Additional amounts of heat must be supplied to melt sufficient wax for the creation of a mark of the desired size on the medium. At the cooler print medium, the wax starts to chill and begins to solidify.

The medium and ribbon are permitted to remain in contact during travel away from the print head, during which time the solidifying wax preferentially adheres to the medium rather than the ribbon. The ribbon is then separated from the web and travels to a take-up roll. The web medium travels to the next print station where the printing process is repeated with a wax of a different color.

In printing on a moving web, it is important to determine where a dot is to be deposited. It is therefore important to determine when the mark is to be deposited. With conventional printers of the prior art, usually the time available for depositing a line of colored dots was sufficiently ample to permit printing whenever it was reasonably certain that the correct printing location for a line of marks had arrived at the print head. When the printing location for the next line of marks reached the print head, the next line was printed.

As the web moves, there are "windows" of opportunity within which a dot row must be printed. If the human eye is to be satisfied with the result, the dots must be aligned in a direction transverse to the direction of travel of the medium and the spacing between adjacent lines must be uniform. Further, and depending upon the subject matter of a document, the alignment and registration requirements may be quite stringent because of the sensitivity of the eye to misalignments, especially in patterns that include straight lines and smooth curves.

It would be desirable to have a relatively high speed (up to approximately 12 inches per second or greater) full color (three primary colors plus black) thermal printer that can reliably and repeatably generate images that accurately represent a "picture". The source of images may be an image file in a computer and result from the manipulation of an image creating computer program. It is equally possible to "scan" color "documents" from a variety of sources into a computer file using presently available scanners and programs. Such "documents" can be printed using a color printer without the need of creating a plurality of engraved printing plates.

Such a printer should have a resolution on the order of 1200 "dots per inch" (dpi) or greater and be capable of printing upon various media including paper, fabric, plastic film or metallic foil. The color palette should permit a range of colors and hues sufficient for perception by the human eye. Generally a color range of from 64 to 256 shades for each primary color and black, which can be represented by up to 32 data bits should suffice.

So that monochromatic ribbons can be used in the printing process and to obviate the need for reversing web travel between colors, four dedicated printing heads should be serially arranged in the path of the moving web. The printed images from each of the print heads should maintain accurate registration and the row-to-row spacing of adjacent printed rows should remain constant.

According to the present invention, a full color thermal printer capable of achieving print speeds of or exceeding 12 inches per second utilizes digital computers to assist in determining not only the time window during which the dot row to be printed will be available to the print head, but also the optimum time, duration and magnitude of electrical impulses which are to be applied to the individual electrodes of a thermal print head to effectuate printing of a mark.

A high resolution encoder signals paper travel through the printer. For those incremental areas which are to be printed with more than one color, it is important that the electrodes of subsequent heads printing individual colors be heated sufficiently such that the colored wax liquefies and is deposited directly over the wax dot applied by a prior print head. The magnitude and duration of the electrical impulse to the printing electrode can determine the size of the dot of wax which is transferred to the web medium and the precise location that the dot will occupy.

In order for an image generating device such as a thermal printer to function at high speeds in the production of full color images in a single pass requires radical improvements in the web transport apparatus. The web transport apparatus must be configured so that the precise location of each increment of the media comprising the web is tracked by the media management device.

Based upon accurate counting of the roll-out length of the media, the image generating element can, through association with a computing means, be programmed to lay down the points or "dots" of an image in the proper locations at the precise moment that media area passes over the corresponding image marking element which, in the case of a thermal printer would be a print head nib. Where full color is achieved by the overlay of three colors and black, this web transport apparatus includes individual print position registers in which digital counts representing the distance between print stations can be stored.

It is of course essential that the frame be rigid and that all elements be securely mounted so as to retain their positions relative to each other. It is also important that absolute parallelism be maintained among the several printing heads. A relatively high level of tension must be maintained on the web medium to avoid slack so that the encoder consistently and reliably signals the passage of the web through the system. It is also necessary that a count stored in a print register accurately represents distances.

For example, a count in a first register associated with a first printing station represents the distance required for the web medium to come up to speed from a stop. A second register, associated with the next printing station would store a count that represented the start up distance and the distance between the first station and the next station.

Similarly, a third register would store a number equal to the number stored in the second register plus a number equalling the distance between the second and third print stations. Finally, in the four color printer, the number stored in a fourth register would be the number in the third register plus the distance from the third to the fourth print station.

Thermal expansion or contraction of the printer frame, as it affects the distance between print stations can be accommodated by a simple numerical adjustment of the contents of the registers. These adjustments, as a function of temperature could be stored in the digital computer and could be obtained from a look up table.

Moreover, accurate registration can easily be achieved from calibration runs in which a simple pattern is printed. The printed pattern can be examined under a microscope or high power loupe. Registration errors can be corrected by changing the numbers stored in the various registers. Where the encoder provides several pulses between dot rows, skilled operators can provide numerical adjustments for virtually perfect registration in two or three test printings.

Accordingly, it is an object of the invention to provide a media management device which includes a web transport apparatus which allows for precise location of the web and highly accurate placement of color dots by successive image generating elements in a single pass.

It is a separate object of the invention to provide a web transport apparatus that operates at high speeds to reliably and repeatably generate color picture images.

It is a separate object of the invention to provide a web transport apparatus using a high resolution encoder which signals web travel through the apparatus.

A further object of this invention is to provide a high speed web printer with a high resolution encoder which produces a predetermined number of pulses representing the distance from one dot row of imaged dots to the next row, enabling accurate registration of multiple lines of dots.

A further object of this invention is to utilize digital registers which can compensate for thermal changes by varying a stored count representing the linear distance between image generating heads.

It is a further separate object of the invention that the web transport apparatus include web drive motors at each image generating station controlled by feedback loops whose control signals are derived from the feedback loop of the motor at the first image generating station to operate in "tug of war" fashion for optimal tensioning of the web.

A further object of the invention is to provide a web transport apparatus with sufficient tension on the web such that an image source media (e.g.ribbon, in the case of thermal wax printing) separates from the medium after the transferred wax or other image forming material has been affixed to the target medium and preferentially remains with the target medium.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF DRAWINGS

Figure 1:
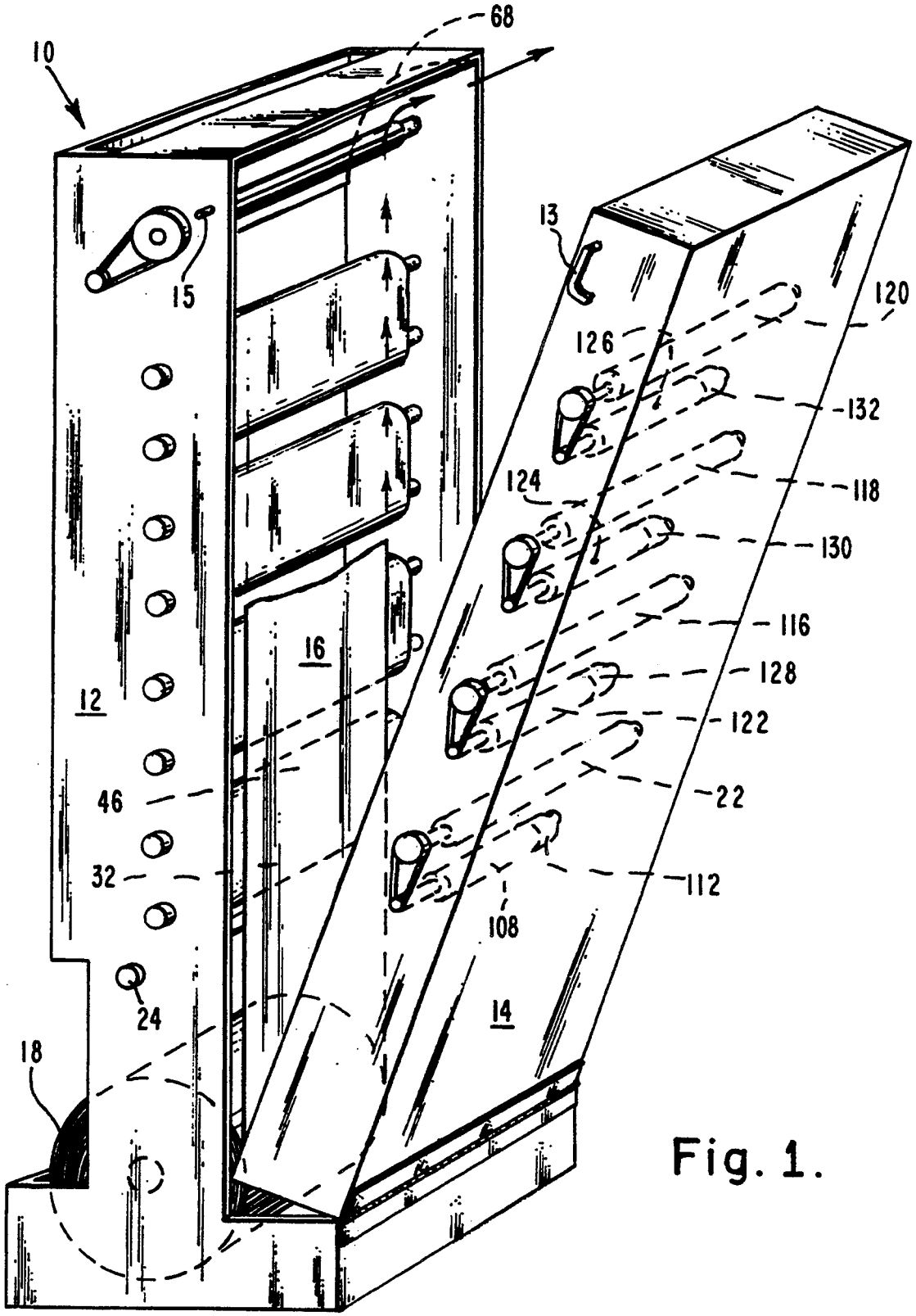
FIG. 1 shows a perspective view of the media management device in an open position.

FIG. 1 illustrates the media management apparatus of the present invention which is incorporated in a high speed thermal printer 10. The printer 10 includes a frame 12 to which is hinged a door 14. A medium or web 16 is provided to receive images and in the thermal printer application is preferably paper.

A supply source 18, can either be a spool of paper or a z-folded stack located in the bottom portion of the frame 12. The web 16 spans the entire length of the frame 12, (which is configured to be vertical) and is placed between the frame 12 which contains most of the operating components and the door 14 which contains cooperating elements. A latch 13 on the side of the door 14 hooks onto a complementary post 15 on the frame 14, to lock the two portions together in close and stable proximity.

Figure 2:
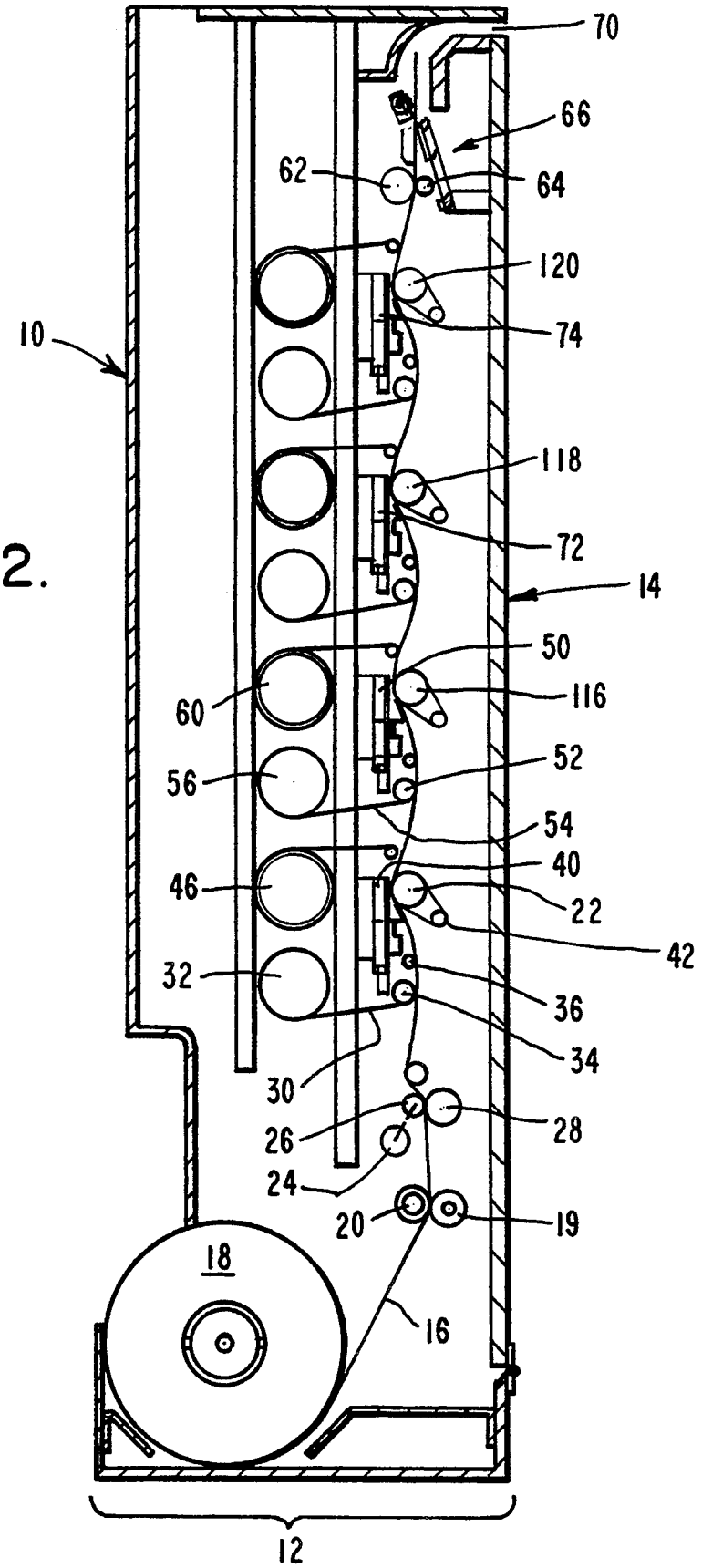
FIG. 2 is a side sectional view of media management device according to the present invention.

FIG. 2 is a side section view of the printer 10. Closing the door 14 into the frame 12 with the web 16 in between the two "sandwiches" the web 16 between a series of elements, some on the frame 12 and some on the door 14. All are precisely located in relation to other elements and in relation to the web 16.

Firstly, the web 16 passes between an elastomeric first pinch roller 19 located on the door 14 and an elastomeric brake roller 20 mounted to the frame 12. The brake roller 20 applies a constant drag on the web 16 as it travels toward a drive roller 22. The combined action of the elastomeric first pinch roller 19 and the brake roller 20 applies tension to the web 16. The drive roller 22 is situated farther along on the web 16 path at a first printing station and is the prime mover of the web 16.

The tractor force of the drive roller 22 on the web 16 acting against the drag of the brake roller 20 eliminates slack in the web 16 and minimizes the path length and applies substantial tension to the web 16. In an embodiment of the invention as a thermal printer, braking tension of approximately 2.0 kg gives satisfactory results using paper as the web material.

Between the brake roller 20 and the drive roller 22 is a high resolution digital incremental shaft position encoder 24. In a preferred embodiment, the encoder 24 provides 4,000 counts per revolution. A metal encoder roller 26 of precisely known diameter is in non slip contact with the web 16 and is held by an elastomeric encoder pinch roller 28. A spring force urges the pinch roller 28 against the web 16 and the encoder roller 26.

As the web 16 is drawn between the encoder roller 26 and the second pinch roller 28, it rotates the encoder roller 26, signalling with each revolution or partial revolution each time a predetermined incremental length of web 16 has entered the web travel path through the printer. The circumference of the encoder roller 26 determines the distance represented by each encoder pulse.

Since the web 16 is held taut, and the precision ground metal encoder shaft 26 is maintained in close contact with the web 16 with no play or slippage, the measurement of the distance of web 16 travel from the encoder roller 26 can be extremely precise, enabling the position encoder 24 in the preferred embodiment to measure to within 1/4000 of a revolution. Other encoders are available with greater or fewer counts per revolution.

This precision enables accurate registration of the several dot colors since the encoder roller 26 is sensitive to movements in the web 16 as slight as 1/9th the diameter of a single dot where the resolution is 300 dpi. Alternatively, one pulse represents $3.7\times10^{-4}$ inches (0.00037") or 0.370 mils of web 16 travel. In the image generation process, it has been found expedient to count 9 pulses from one dot row to the next. The number of pulses per inch of web travel depends upon the resolution of the encoder and the diameter of the roller shaft and can be chosen for each combination of web speed and print resolution. For example, the pulses per dot row should be enough to conveniently subdivide the dot row when dealing with higher resolutions such as 600 or 1200 dpi.

An image source medium such as a colored wax coated ribbon 30 in the case of TWT printing, is supplied by a braked supply roll 32 mounted in the frame 12. The ribbon 30 is withdrawn from the braked supply roll 32 taut and wrinkle free against the drag of the brake. A supply guide rod 34 initially brings the ribbon 30 and the web 16 together.

A second guide rod 36 directs the web 16 to the drive roller 22. A cover 38 protects the print head 40. The web 16 and ribbon 30 "sandwich" are brought into the printing region where the sandwich passes between the print head 40 and the first drive roller 22 which is attached using linkages to the door 14. A timing belt and pulley arrangement 42 couple the elastomeric first drive roller 22, to a first drive motor shown in FIG. 3. A spring force heavily biases the drive roller 22 against the web 16 on the non-image receiving side of the medium and, ultimately, against the ribbon 30 and the print head 40. In the present case of a thermal wax transfer printer, the print head 40 and all additional print heads are multi electrode thermal print heads.

Beyond the first image generating station 40, a separator bar 44 on the frame side guides the web 16 during separation from the ribbon 30 which, after printing, is directed to a first take-up spool 46 which collects the expended ribbon 30. The first take-up spool 46 is rotated in a counter clockwise direction by a constant torque motor (not shown) which assists in the separation of the ribbon 30 from the web 16 at the separator bar 44.

Figure 3:
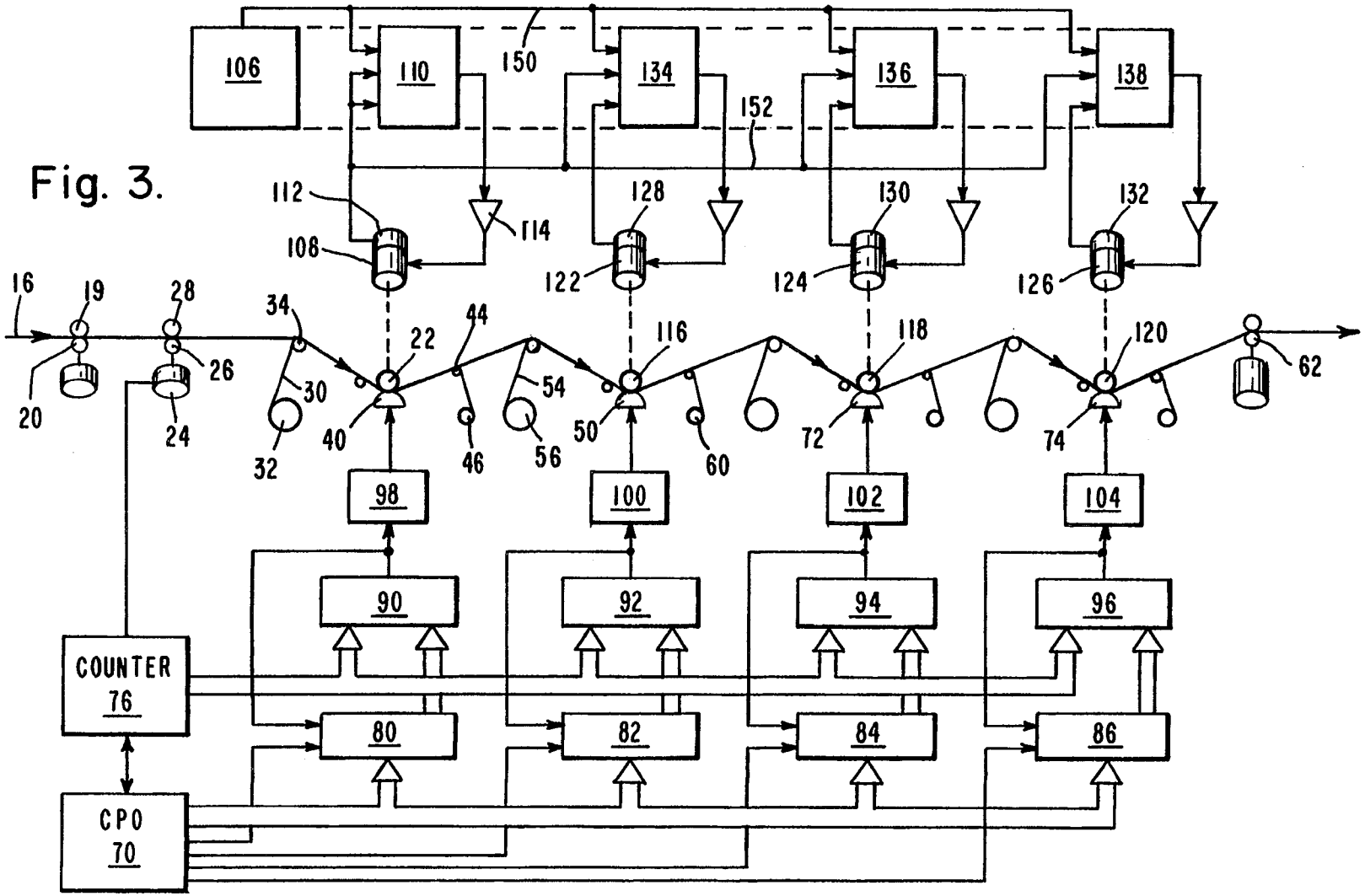
FIG. 3 is a block diagram of the device of FIG. 2.

In a device which includes multiple image generating stations, such as a four color thermal wax transfer printer, the web 16 moves onward to a second print head 50, which is parallel to the first print head 40. Approaching the second print head, the web 16 passes a second supply guide rod 52 on the frame 12 which guides a second ribbon 54 from a second braked spool 56 into a sandwich with the moving web 16. The web 16 and ribbon 30 sandwich proceeds to the second print head 50 and is subjected to pressure from a second drive roller 58 which is driven by a second drive motor as shown in FIG. 3. The second drive motor applies a traction force to the second drive roller 58 which maintains the tension in the web 16.

After printing, the expended ribbon 54 is wound onto a second take-up spool 60 which operates in the same manner as the first take-up spool 46. The web 16 continues through two more substantially identical printing stations and a final drive roller 62 with its associated idler 64. This final drive roller 62 directs the web 16 to a cutting device 66 which can sever the web 16 into documents of predetermined length. The web 16 travel path continues through a guide 68 and ultimately exits the printer through an exit gap 70 between the top of the door 14 and the frame 12.

FIG. 3 is a block schematic diagram showing the interrelationship between the encoder 24 and the actual generation of an image at the first through fourth print heads 40, 50, 72, 74. The encoder 24 transmits output pulses which correspond to web 16 movement to a position counter 76. The counter 76 is also connected to a computer or central processing unit (CPU) 78, which is programmed to communicate with the counter 76 and first through fourth registers 80, 82, 84, 86.

Each register 80, 82, 84, 86 is connected to a respective first through fourth comparator 90, 92, 94, 96, each of which receives an input from the counter 76. The output of each of the comparators is applied to a corresponding first through fourth pulser 98, 100, 102, 104 which supply printing impulses to the first through fourth print heads 40, 50, 72, 74, respectively To initiate printing, each of the registers is preloaded with a preselected count. The first register 80 is pre set with a count which represents the length of web 16 that will travel through the printer while accelerating from a resting state to its steady state velocity. In the preferred embodiment of a four color thermal wax printer operating at 300 dpi, the preselected count 2,000, which allows the web 16 to reach its operating velocity and to attain the desired tension before the first print signal is generated.

The second register 82, is preloaded with a count that represents sum of the count in the first register 80 plus a count that represents the distance between the first print head 40 and the second print head 50 (i.e. 12,000) for a total of 14,000. In the preferred embodiment, the print heads are equidistant from each other so that the third register 84 can be preloaded with a count equal to the count preloaded in the second register 82 plus the count representing the distance between the second print head 50 and the third print head 72 (i.e. 12,000) for a total of 26,000.

The fourth register 86 follows the same pattern of calculation which results in a preload count of 38,000. Because the installation of the print heads cannot be held to such high tolerances, the actual distance between print heads may vary slightly. Accordingly, each preload count can be adjusted through the CPU 78 after sample print runs are examined. As a result, new distance values for each of the print heads can be stored in the computer and preloaded in the register for subsequent printing runs.

The first comparator 90 provides an output pulse at the instant the web 16 position signalled by the encoder 24 and accumulated in the counter 76 becomes equal to the value stored in the first register 80. With each output pulse from the first comparator 90, a feedback signal is applied to the first register 80 to increase the value stored therein by a preselected amount. In the present embodiment, which prints at a density of 300 dpi, the preselected amount is 9, representing the count corresponding to the distance between printed rows. Thus, after the first line is printed, each time the count in the counter 76 increases by 9, an output pulse is generated by the first comparator 90 and the first register 80 is again incremented by 9.

The first comparator 90 output pulse is received by the first print pulser 98 which, in turn, sends a print pulse to the first print head 40. Likewise, when the cumulative count sent out by the counter 76 to the second through fourth comparators 92, 94, 96 matches the preloaded value in the second register 82, an output signal is generated by the second comparator 92 and applied to the second print pulser 100 which in turn sends a printing impulse to the second print head 50. The second comparator 92 output signal increments the second register by an count of 9.

The process of matching preset values with the cumulative count generated by the counter 76 and the subsequent generation of a printing impulse to the print head is the same with the third and fourth comparators 94, 96 and the attendant third and fourth registers 84, 86, third and fourth pulsers 102, 104 and third and fourth print heads 72, 74.

In summary, the print head 40 will respond to a pulse which is generated at the instant the comparator 90 matches the predetermined count which it contains with the count in the counter 76 which accumulates the counts generated by the position encoder 24 in response to the movement of the web 16. However, since there is only one position encoder 24 shaft which is located at a point near the beginning of the web's travel, and the print heads 40, 50, 72, 74 are downstream from that point, the path length of the web 16 must be held constant. All of the print heads print only in response to a signal from their respective comparators. The accuracy of the printed copy is totally reliant upon the parallelism of the heads and their fixed location and the consistent path length of the web 16 once it passes the encoder 24 shaft location.

In order to achieve this requisite level of precision, constant tension on the web is critical. Referring now to FIG. 3, a motor control unit 106 is capable of controlling the torque and the velocity of one or more motors in accordance with commands received from the CPU 78. As shown, the motor control unit 106 includes several inputs to derive control signals which are applied to each of the motors driving the drive roller at each print head.

The first drive roller 22 which is driven by the first drive motor 108 is maintained at the proper velocity and torque by a first feedback loop 110 that includes signals from an encoder 112 that is integral with the motor 108. The first feedback circuit 110 provides an "error" voltage signal to a first amplifier 114 which converts it to a current signal that is applied to the motor 108.

The feedback circuit receives a control signal from the motor control circuit 106, a position representing signal from the encoder 112 and a velocity signal from the encoder 112. The encoder 112 is an incremental encoder that provides a pulse with each increment of motor rotation. Counting the pulses gives a position indication and measuring the time between pulses indicates velocity.

The drive roller 22 pulling the web against the drag of the brake roller 20 maintains the tension in the web to the first print head 40. Should the drag increase, the motor will be slowed and the feedback circuit will generate an error signal voltage, which when applied to the first amplifier 114 which converts the voltage to a current signal. Since the torque of a motor is a function of the applied current, the torque is increased until the drag is overcome and the velocity is increased.

The increased velocity is noted in the feedback circuit and the error signal is reduced, thereby reducing the current being applied to the motor 108. The feedback circuit 110 stabilizes the velocity by increasing the torque to compensate for all of the drag components resulting in a stable velocity and a constant tension.

The second and subsequent drive rollers 58, 118, 120 are respectively driven by second and subsequent substantially identical drive motors 122, 124, 126 each with substantially identical integral encoders 128, 130, 132. The second and subsequent feedback loops 134, 136, 138 each receive signals from the motor control circuit 106 as well as velocity representing signals from the associated integral encoders 128, 130, 132. However, the position signal derived from the first encoder 112 is also applied to the second and subsequent feedback loops 134, 136, 138 as a control signal to slave the second and subsequent drive motors 122, 124, 126 to the torque of the first drive motor 108.

This modification of the feedback circuits assures that all of the drive motors will operate in "tug of war" fashion with the pace being set by the first drive motor 108 and the subsequent drive motors providing tractor force sufficient to maintain constant tension within the web 16 and to overcome whatever drag might be encountered from the ribbon supply rolls or friction at the print heads.

Alternative embodiments can include a single drive motor that is coupled to all of the drive rollers through a gear and clutch train, in which case only a single feedback loop would be necessary. For the feedback circuit, comparable signals are derived from an integral encoder that is included on the motor and from a signal that can be provided by the motor control circuit 106 or from the CPU 78.

Experts skilled in the art may suggest modifications and variations which will be within the ambit of the present invention. Accordingly the breadth of the invention should be limited only by the scope of the claims appended hereto.

What is claimed as new is:

1. An improved web transport apparatus comprising:

a. tractor means for moving the web in a desired direction of travel, said tractor means including at least one deformable driving capstan roller and further including bias means urging said capstan roller against said web treatment means;

b. web tensioning means cooperating with said tractor means to maintain the web under substantial tension throughout a transport path;

c. counting means in contact with the web when placed in motion by said transport means, for generating count signals corresponding to and representative of the passage of an incremental length of web through the apparatus and including counter means for accumulating count signals;

d. first settable register means including comparator means coupled to receive signals from said counter means corresponding to the count stored therein, said register means being adapted to receive a count representative of a first predetermined distance for generating a first actuating signal when the distance travelled increment of web, as represented by counter means signals, is equal to the predetermined distance from the location of said counting means; and e. first web treatment means at a first work station displaced from said counting means in the direction of web travel, connected to said comparator means and operable in response to said first actuating signal to initiate a treatment activity on the web.

2. The improved web transport apparatus as in claim 1, further including feedback means connected between said settable register means and said comparator means to increment said register means by a preset number for generating a subsequent actuating signal each time a number of count signals equal to the preset number is received by said counter means.

3. The improved web transport apparatus as in claim 1, further including drag means in the web path in advance of said counting means for creating constant tension in the web to minimize the web travel path, permitting precise and repeatable determination of the location of an incremental area of web material.

4. The improved web transport apparatus as in claim 3, wherein said counting means include an incremental shaft encoder for quantifying each increment of web travel whereby the cumulative count stored in said counter means represents the length of web that has passed said counting means.

5. The web transport apparatus as in claim 1, further including second settable register means and second comparator means coupled to receive signals from said counter means, and adapted to receive a count representative of the predetermined distance and the distance between said first work station and a second work station, for generating a second actuating signal when the distance travelled by an increment of web, as represented by the count stored in said counter means, is equal to the predetermined distance from the location of said counting means plus the distance between said second work station and said first work station, and second web treatment means at said second work station, said second actuating signal initiating a treatment activity on the web at said second work station.

6. The improved web transport apparatus as in claim 5, further including first feedback means connected between said settable register means and said comparator means to increment said register means by a preset number for generating a subsequent actuating signal each time a preset number of count signals is received by said counter means.

7. The improved web transport apparatus as in claim 6, further including second feedback means connected between said second settable register means and said second comparator means to increment said second register means by the preset number for generating a repeating second actuating signal to initiate a treatment activity each time a preset number of count signals equal to the preset number is received by said counter means from said counting means.

8. The web transport apparatus as in claim 7, further including third settable register means and third comparator means coupled to receive said counter signals, and adapted to receive a count representative of the predetermined distance plus the distance between said first work station and a third work station, for generating a third actuating signal when the distance travelled by an increment of web, as represented by the count stored in said counter means, is equal to the predetermined distance from the location of said counting means plus the distance between said third work station and said first work station, and third web treatment means at said third work station, said third actuating signal initiating a treatment activity on the web at said third work station.

9. The improved web transport apparatus as in claim 8, further including a third feedback means connected between said third settable register means and said third comparator means to increment said third register means by the preset number for generating a subsequent third actuating signal each time a number of count signals equal to the preset number is received by said counter means to initiate a treatment activity each time the preset number of count signals is received by said counter means from said counting means equals the preset number.

10. The web transport apparatus as in claim 8, further including fourth settable register means and fourth comparator means coupled to receive signals from said counter means, and adapted to receive a count representative of the predetermined distance plus the distance between said first work station and a fourth work station, for generating a fourth actuating signal when the distance travelled by an increment of web, as represented by the count stored in said counter means, is equal to the predetermined distance from the location of said counting means plus the distance to the location of said fourth work station from said first work station, and fourth web treatment means at said fourth work station, said fourth actuating signal initiating a treatment activity on the web at said fourth work station.

11. The improved web transport apparatus as in claim 10, further including a fourth feedback means connected between said fourth settable register and said fourth comparator means to increment said fourth register means by the preset number for generating a subsequent fourth actuating signal to initiate a treatment activity each time the preset number of count signals is received by said counter from said counting means.

12. The web transport apparatus as in claim 5, wherein each of said web treatment means has an associated deformable driving capstan applying a primary driving force at the respective work station which maintains sufficient tension to assure constant web velocity in the vicinity of each work station.

13. The web transport apparatus as in claim 1, wherein said tractor means include a first driving capstan powered by a first motor including first-encoder means for monitoring first motor position, said apparatus including first feedback means coupling said first encoder means and said first motor for regulating the torque of said first motor through a first feedback loop which includes, as one control signal, the output of said first encoder means.

14. An improved web transport apparatus comprising:

a. tractor means for moving the web in a desired direction of travel said tractor means including at least one deformable driving capstan, and means for highly biasing said capstan against said web treatment means such that the web is driven by said driving capstan and which capstan applies a primary web driving force;

b. web tensioning means cooperating with said tractor means to maintain the web under substantial tension throughout a transport path;

c. counting means in contact with the web when placed in motion by said transport means, for generating count signals corresponding to and representative of the passage of an incremental length of web through the apparatus and including counter means for accumulating count signals;

d. first settable register means including comparator means coupled to receive signals from said counter means corresponding to the count stored therein, said register means being adapted to receive a count representative of a first predetermined distance for generating a first actuating signal when the distance travelled by an increment of web, as represented by counter means signals, is equal to the predetermined distance from the location of said counting means; and e. first web treatment means at a first work station displaced from said counting means in the direction of web travel, connected to said comparator means and operable in response to said first actuating signal to initiate a treatment activity on the web.

15. The web transport apparatus as in claim 14, wherein said web tensioning means include at least one braking roller which is held to the web by a highly biased pinch roller and which serves, in concert with said capstan to impart sufficient tension to the web to assure constant web velocity in the vicinity of said web treatment means.

16. An improved web transport apparatus comprising:

a. tractor means for moving the web in a desired direction of travel, said tractor means including a first driving capstan powered by a first motor including first encoder means for monitoring first motor position, said apparatus including first feedback means coupling said first encoder means and said first motor for regulating the torque of said first motor through a first feedback loop which includes, as one control signal, the output of said first encoder means;

b. web tensioning means cooperating with said tractor means to maintain the web under substantial tension throughout a transport path;

c. counting means in contact with the web when placed in motion by said transport means, for generating count signals corresponding to and representative of the passage of an incremental length of web through the apparatus and including counter means for accumulating count signals;

d. first settable register means including comparator means coupled to receive signals from said counter means corresponding to the count stored therein, said register means being adapted to receive a count representative of a first predetermined distance for generating a first actuating signal when the distance travelled by an increment of web, as represented by counter means signals, is equal to the predetermined distance from the location of said counting means;

e. first web treatment means at a first work station displaced from said counting means in the direction of web travel, connected to said comparator means and operable in response to said first actuating signal to initiate a treatment activity on the web; and f. additional web treatment means at additional work stations, said tractor means including additional capstans each driven by a motor at each additional work station, each additional work station motor including an encoder and feedback means, each additional work station motor receiving as an input signal said first feedback means signal so that the driving force, at each additional work station is controlled by the driving force at the first work station and is maintained at all of the successive work stations.

* * * * *